US008817995B2

(12) United States Patent
Huijser et al.

(10) Patent No.: US 8,817,995 B2
(45) Date of Patent: Aug. 26, 2014

(54) CONTROL OF A LOUDSPEAKER OUTPUT

(75) Inventors: Jan-Paulus Freerk Huijser, Wychen (NL); Johan Somberg, Wijchen (NL)

(73) Assignee: NXP B.V., Eindhoven (NL)

( * ) Notice: Subject to any disclaimer, the term of this patent is extended or adjusted under 35 U.S.C. 154(b) by 536 days.

(21) Appl. No.: 13/161,023

(22) Filed: Jun. 15, 2011

(65) Prior Publication Data

US 2012/0020488 A1 Jan. 26, 2012

(30) Foreign Application Priority Data

Jun. 16, 2010 (EP) ..... 10166206

(51) Int. Cl.
*H04R 29/00* (2006.01)
*H04R 3/00* (2006.01)
*H03G 11/00* (2006.01)

(52) U.S. Cl.
CPC ..... *H04R 29/003* (2013.01); *H04R 3/007* (2013.01)
USPC ..... 381/59; 381/55

(58) Field of Classification Search
USPC ..... 381/55, 58, 59, 120, 397, 92, 93, 96, 381/312; 330/284; 324/713
See application file for complete search history.

(56) References Cited

U.S. PATENT DOCUMENTS

2002/0146136 A1 10/2002 Carter
2004/0178852 A1* 9/2004 Neunaber ..... 330/284

FOREIGN PATENT DOCUMENTS

CN 2779775 5/2006

OTHER PUBLICATIONS

Microchip, Temperature sensor Design Guide, Feb. 2009, PDF Document attached.*
"Sound System Equipment", part 1, International Standard CEI/IEC No. 268-1, 38 pgs. (1985).
Klippel, W. "Distortion Analyzer—a New Tool for Assessing and Improving Electrodynamic Transducer", AES convention paper, 111th Convention, Paris, France, 35 pgs. (Feb. 2000).
Klippel, W. "Active Compensation of Transducer Nonlinearities", AES 23rd Int'l. Conference, Copenhagen, Denmark, 17 pgs. (May 2003).
Klippel, W. et al. "Loudspeaker Testing at the Production Line", AES Convention paper, 120th Convention, Paris, France, 2 pgs. (2006).
Klippel, GmbH "Accessories of the Klippel QC System A6", 3 pgs. (Mar. 2010).
Elektroakustische Gerate—Elektroakustische Wandler, DIN EN 62458, 26 pgs. (Jul. 2011).
Klippel, W., Letter to European Patent Office regarding appln. EP2398253, bearing the EPO-Munich date-stamp, 4 pgs. (Oct. 2012).
Klippel, W., letter to European Patent Office regarding appln. EP2398253, , 3 pgs. (Oct. 2012).
Behler, G. et al. "Measuring the Loudspeaker's Impedance During Operation for the Derivation of the Voice Coil Temperature", AES Convention Preprint, 14 pgs. (1995).

(Continued)

*Primary Examiner* — Vivian Chin
*Assistant Examiner* — Ammar Hamid

(57) ABSTRACT

A method of controlling a loudspeaker of an electronic device provides voice coil temperature protection. When a power supply for the electronic device is first activated, a binding step is performed in which the loudspeaker impedance is determined and a temperature (such as ambient temperature) is accurately measured. These binding step measurements are used during subsequent use of the loudspeaker, to make the temperature measurements (based on voice coil impedance) as accurate as possible.

13 Claims, 1 Drawing Sheet

(56) References Cited

OTHER PUBLICATIONS

Klippel, W. "Nonlinear Modeling of the Heat Transfer in Loudspeakers", J. Audio Eng. Soc., vol. 52, No. 1/2, pp. 3-25 (2004).

Extended European Search Report for European Patent Appln. No. 10166206.2 (Oct. 12, 2010).

Specification & drawings from U.S. Appln. No. 13/021,486, 35 pgs. (Feb. 4, 2011).

* cited by examiner

CONTROL OF A LOUDSPEAKER OUTPUT

This application claims the priority under 35 U.S.C. §119 of European patent application no. 10166206.2, filed on Jun. 16, 2010, the contents of which are incorporated by reference herein.

FIELD OF THE INVENTION

This invention relates to the control of the output of a loudspeaker.

BACKGROUND OF THE INVENTION

It is well known that the output of a loudspeaker should be controlled in such a way that it is not simply driven by any input signal. For example, an important cause of loudspeaker failures is a mechanical defect that arises when the loudspeaker diaphragm is displaced beyond a certain limit, which is usually supplied by the manufacturer. Going beyond this displacement limit either damages the loudspeaker immediately, or can considerably reduce its expected life-time.

It is also well known that the drive signal to the speaker should avoid thermal damage. Loudspeakers are devices which convert electrical energy into acoustical energy. However, much of the electrical power that is applied to the loudspeaker results in heat dissipation, which causes many of the common loudspeaker defects. To prevent thermal damage (permanent or transitory), it is desirable to measure the voice coil temperature of the loudspeaker, and to condition the input in such a way that this temperature does not exceed a certain limit.

One way to estimate the voice coil temperature is to predict its value from the electrical signal that is sent to the loudspeaker using a mathematical model of the loudspeaker using a number of pre-estimated parameters, see e.g. Klippel, W., 2004. *Nonlinear Modeling of the Heat Transfer in Loudspeakers* Audio Eng. Soc. 52, 3-25.

A different approach is to measure the current and voltage in the voice coil directly and estimate its temperature based on those measurements. This approach is taken in Behler, Gottfried; Spätling, U.; Arimont, T. *Measuring the Loudspeaker's Impedance During Operation for the Evaluation of the Voice Coil Temperature* in Proceedings of the 98th AES Convention, 5 Paris. Paper number 4001.

From the measured voltage and current, the DC resistance of the loudspeaker, referred to as Re, is determined. The DC resistance is estimated as the average of the real part of the impedance for frequencies in the vicinity of the minimum impedance exceeding the resonant frequency of the loudspeaker. Since the DC resistance depends on the temperature of the voice coil, the temperature can be determined from the DC resistance.

It is known to combine voice coil excursion protection and temperature protection using a digital signal processor which receives the voice coil voltage and current measurements explained above. The cone excursion protection is based on the generic speaker model, taking into account the audio signal provided to the speaker, but tuned by the current measurement and voltage measurement signals. The temperature protection is based on determination of the temperature from the current and voltage measurements.

This invention is concerned in particular with the accuracy of the speaker temperature detection. To protect the speaker well, the speaker temperature needs to be measured with an accuracy of around +/−5° C. The background for this is that the maximum ambient temperature is typically 85° C., and the maximum allowed speaker coil temperature is typically 105° C. (depending on the materials, glues, type of magnets etc.). Thus, there is only a permitted temperature rise of 20° C. above the ambient temperature (85° C.) allowed for the speaker to be able to manage the heat dissipation. As a result, a very accurate temperature measurement for the speaker coil is needed for a practical system.

As explained above, the temperature changes in a speaker can be detected by measuring the dc resistance of the speaker. This resistance is dependant on the temperature as a result of the temperature coefficient of the wire used for the speaker coil.

However, the speaker has an impedance spread caused by the speaker production process. For a typical mobile phone speaker, the nominal resistance is defined as 8 Ohm+/−10%.

The temperature coefficient of a typical copper/silicon compound wire, used to make the speaker coil in mobile phone speakers, is in the order of 0.38%/° C.

This means that a spread of 10% in the nominal dc speaker impedance will already cause an in-accuracy of +/−25° C. in the temperature measurement for the speaker coil.

As the speaker impedance can spread by +/−10% during production of the speaker it is required to take account of the actual connected speaker impedance to be able to measure accurately in real time the speaker coil temperature.

SUMMARY OF THE INVENTION

According to the invention, there is provided a method of controlling a loudspeaker of an electronic device to provide voice coil temperature protection, comprising:

when a power supply for the electronic device is first activated, performing a binding step, which comprises taking measurements to enable determination of a loudspeaker impedance and measuring a temperature;

during subsequent use of the loudspeaker, taking measurements to enable monitoring of the loudspeaker impedance, and deriving the temperature using the measured temperature and corresponding loudspeaker impedance determined from the measurements taken in the binding step.

The invention concerns the problem of correlating a speaker temperature to the connected speaker impedance. This process can be considered to be a binding process.

The invention uses a temperature sensor to implement an accurate and calibrated temperature measurement which is used when connecting the power supply (e.g. supply battery) for the first time, as part of a calibration step.

During this calibration step, measurements are taken to enable the speaker impedance to be derived as well as accurately measuring a temperature. It is assumed during this calibration moment that the speaker temperature will be the same as ambient temperature, so that the temperature sensor does not need to be in close proximity to the speaker voice coil. For example, the temperature sensor can be part of an amplifier circuit used to drive the speaker, part of a codec, or part of any other integrated circuit forming part of the device.

The temperature sensor can be very accurate to provide accurate binding. For example, the temperature sensor can comprise a trimmed on-chip temperature sensor.

Taking measurements to enable determination of the loudspeaker impedance in the binding step can comprise using a tone signal to drive the loudspeaker. The measurements can comprise the voice coil voltage and current, and the determined and monitored loudspeaker impedance can comprise the voice coil resistance.

Thus, known voltage and current measurements can be used to perform the impedance monitoring.

The method preferably comprises storing in memory the binding step measurements. These are used for the subsequent temperature calculations. However, this can also be used as a way of determining whether or not the binding step has been completed. For example, storing the binding step measurements can comprise overwriting default data, such that the absence of the default data is indicative that the binding step has taken place.

The binding step is preferably performed when the electronic device is first used by the consumer end-user. This means that no binding is required during the product manufacture or testing phases (by the manufacturer), so that there is no need for independent programming of every electronic device.

During subsequent use of the loudspeaker, taking measurements to enable monitoring of the loudspeaker impedance can comprise generating an evaluation signal, and combining an input sound signal with the evaluation signal. The evaluation signal enables the measurements to be taken even if there is no (or an insufficient) speaker signal being generated in response to the audio input signal.

Generating an evaluation signal and combining it with the input sound signal thus ensures that the loudspeaker signal comprises a signal suitable for evaluation, i.e. a signal which has sufficient energy in the frequencies which are monitored and used for adapting the loudspeaker signal. When adapting the loudspeaker signal to respond to the measured temperature, this is in particular in dependency on the monitored response to the evaluation signal. In this way, a continuous monitoring of the temperature of the voice coil is possible, allowing a better and more rapid response. For example, during a period in which the input sound signal comprises insufficient energy for other methods to determine the temperature of the voice coil, the voice coil may cool down. A cooled down voice coil allows the sound pressure to increase somewhat, and needs to be detected so that the adaptation of the audio input signal can be correctly modified. The evaluation signal preferably has a particular evaluation frequency, so that frequency-based analysis is used to obtain the measurements.

The invention also provides a loudspeaker control system, comprising:

- a loudspeaker;
- a sensor for taking measurements to enable determination of a loudspeaker impedance;
- a temperature sensor; and
- a processor, wherein the processor is adapted to:

- implement a binding step during which sensor measurements are taken and a loudspeaker impedance is derived, and a temperature sensor measurement is taken;
- implement monitoring during subsequent use of the loudspeaker, during which monitoring sensor measurements are taken and the temperature is determined using the binding step measured temperature and derived loudspeaker impedance.

The method of the invention can be implemented by a computer program comprising computer program code means, by running the program.

BRIEF DESCRIPTION OF THE DRAWINGS

An example of the invention will now be described in detail with reference to the accompanying drawings, in which.

DETAILED DESCRIPTION OF EMBODIMENTS

The invention provides a method of controlling a loudspeaker of an electronic device to provide voice coil temperature protection. When a power supply for the electronic device is first activated, a binding step is performed in which the loudspeaker impedance is determined and a temperature (such as ambient temperature) is accurately measured. These binding step measurements are used during subsequent use of the loudspeaker, to make the temperature measurements (based on voice coil impedance) as accurate as possible.

Figure 1:
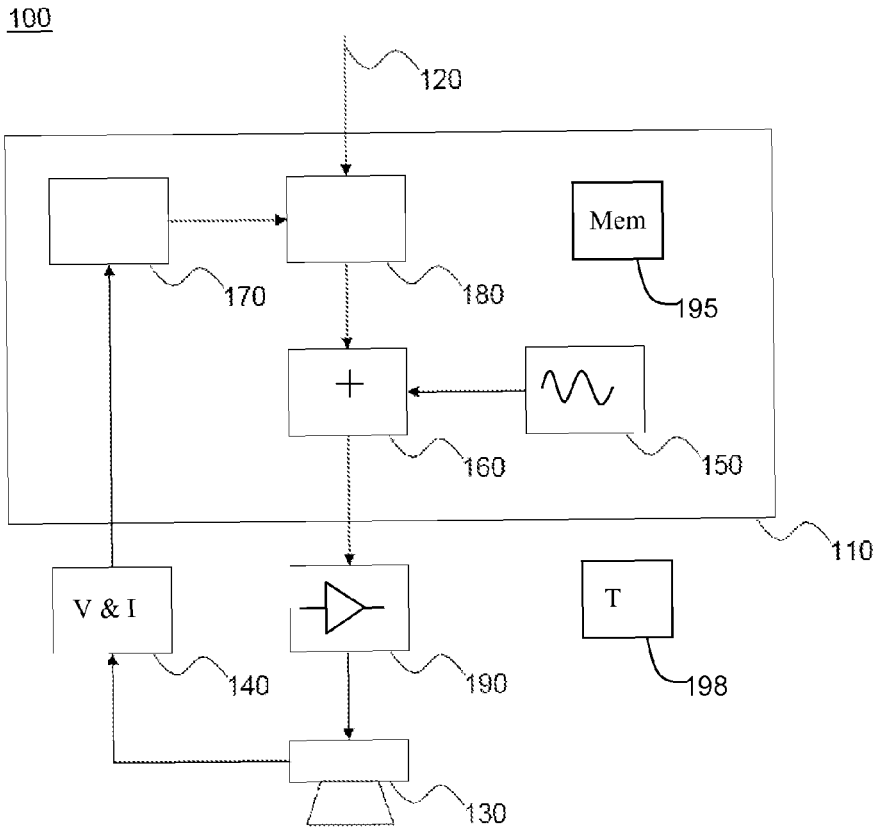
FIG. 1 shows a loudspeaker control system of the invention.

FIG. 1 shows in schematic form a loudspeaker control system which can be controlled in accordance with the invention.

The system 100 obtains an input sound signal 120 from a source. The signal may be received at an input to the system 100. For example, the input sound signal 120 may be obtained from a source external to the system. Input signal 120 may also be retrieved from a storage system. The input signal may be analog or digital. In an embodiment, the system comprises a storage device 195, e.g. a hard disk or a memory such as a flash memory, for storing a digital representation of the input signal, and corresponding retrieval means.

Sound system 100 further comprises a loudspeaker 130. Loudspeaker 130 is configured for receiving a loudspeaker signal and for generating sound in dependency on the loudspeaker signal. Loudspeaker 130 comprises a voice coil for driving the loudspeaker (not shown). The temperature of the voice coil is dependent upon the loudspeaker signal that loudspeaker 130 receives.

The sound system 100 comprises a monitor 140 connected or comprised in loudspeaker 130 for monitoring an electric response of the voice coil to the loudspeaker signal. In particular monitor 140 may be configured to measure the current passing through the voice coil and/or to measure the voltage across the voice coil. Instead of monitoring the current, monitor 140 may be configured to monitor the signal energy, that is, the square of the frequency component of the current at an evaluation frequency.

In all cases, the monitor is for taking measurements to enable determination or estimation of a loudspeaker impedance.

The sound system 100 comprises a processing unit 110 for producing and/or adapting the loudspeaker signal to control the temperature of the voice coil in dependency on the electric response of the voice coil to the loudspeaker signal obtained by monitor 140.

Processing unit 110 is configured to receive or retrieve input sound signal 120 and is connected to loudspeaker 130 for playing the loudspeaker signal and to produce sound. Typically, the processing unit 110 is connected to the loudspeaker 130 via an amplifier 190. The processing unit 110 is connected to monitor 140 for receiving the monitored electronic response.

The processing unit 110 comprises a signal adaption unit 180 for adapting input sound signal 120 to control the temperature of the voice coil. If the temperature of the voice coil is too high or appears to become too high, signal adaption unit 180 may adapt the signal to reduce the temperature, e.g., signal adaption unit 180 may reduce the power level of the input sound signal. For example, signal adaption unit 180 may be configured for attenuation of the input signal, for a filtering operation of the input signal, etc. Signal adaption unit 180 may be configured to apply audio compression, also known as dynamic range compression, to the input sound signal 120.

Any known approach for determining the impedance can be adopted. This can involve measuring the voice coil current and voltage in response to the audio signal used to drive the speaker. However, a preferred approach proposed by the applicant is to provide a signal generator 150 for generating an evaluation signal. Signal generator 150 may be a sine wave generator for generating a sine wave at an evaluation frequency. The processing unit 110 then comprises a combining unit 160 for combining the evaluation signal with the input sound signal 120. For example, the evaluation signal may be added to the input sound signal.

In this embodiment, combining unit 160 combines the adapted input sound signal which it receives from signal adaption unit 180 with the evaluation signal. Combiner 160 forwards the combined signals to loudspeaker 130, via amplifier 190, as the loudspeaker signal.

The evaluation signal may be combined with the input sound signal after amplification.

The evaluation sine wave is combined with the adapted input sound signal, either always or only when there is insufficient input signal energy at the evaluation frequency. For an analog hardware implementation, the sine wave generator and the signal energy detector (at the evaluation frequency) are implemented as electronic circuits, as well as the controller, adapting unit and combiner.

The processing unit 110 comprises a controller 170 for receiving from monitor 140 the monitored electronic response. Controller 170 determines the temperature from the response of the voice coil.

A control signal for controlling signal adaption unit 180 can be derived from the voltage and/or the current signals and is used for controlling the adaptation of the input sound signal in such a way that the voice coil temperature does not exceed a certain temperature threshold.

For this purpose, a control signal is sent from controller 170 to signal adaption unit 180 instructing the latter to adapt the signal for a temperature reduction or not. For example, the voltage across, v, and the current flowing into the loudspeaker voice coil, i, are monitored and are sent to controller 170, which estimates the voice coil temperature or some representation thereof. A control signal that is sent from controller 170 may be a binary signal, instructing signal adaption unit 180 to start a temperature reduction program. A control signal that is sent from controller 170 may comprise a value indicating the magnitude of the desired reduction.

The functionality of controller 170 and signal adaption unit 180 may be shared, for example, controller 170 may determine the impedance at an evaluation frequency and forward the impedance to signal adaption unit 180. Signal adaption unit 180 may adapt the input sound signal such that the temperature in the voice coil is reduced in dependency on this value, e.g., in reverse proportion to the impedance.

A digital implementation may use additional analog-to-digital (ADC) and digital-to-analog (DAC) converters for converting the voltage and current signals to the digital domain. Processing unit 110 may be implemented in software using a DSP or microcontroller.

For a digital implementation, an analog-to-digital (ADC) converter is then placed between monitor 140 and controller 170. A digital-to-analog converter (DAC) is then placed between combiner 160 and amplifier 190.

The input sound signal is applied to the DSP or micro-controller, or it may be stored in the memory of the DSP or micro-controller. The evaluation signal is combined with the input sound signal by the DSP or micro-controller, either always or only when there is insufficient input signal energy at the evaluation frequency. The combined signal is converted to the analog domain by the digital-to-analog converter (DAC), after which it may be amplified and played on the loudspeaker.

The evaluation signal may be generated on the DSP or micro-controller, and the combining, monitoring such as signal energy detection, and estimation steps can also be performed on the DSP or microcontroller. The estimated voice coil temperature may be stored in a memory of the DSP or micro-controller.

The evaluation signal is combined with the adapted input sound signal, and converted to the analog domain and sent to the amplifier and loudspeaker. The voltage across and/or the current flowing into the voice coil are monitored and converted to the digital domain (ADC). They are used for computing the control signal(s). The control signal is optionally smoothed, e.g. by using a moving average.

The system described above provides a temperature determination based on electrical measurements to the speaker. As described above, variations in speaker characteristics mean that individual speaker characteristics need to be taken into account for these measurements to provide accurate temperature measurements. The invention enables the temperature determination in unit 170 to be made more accurate.

This invention provides a binding step. During this binding step, an accurate temperature measurement is taken when connecting the power supply (e.g. battery) for the first time. This can use a very accurate and calibrated temperature sensor inside the amplifier IC, or indeed in any other IC of the device. The temperature sensor is shown in FIG. 1 as component 198.

The temperature sensor can have any suitable design. It is preferably calibrated (otherwise known as trimmed) using an accurate temperature sensor which forms part of the IC test equipment. The temperature sensor can be an analogue device, in which case the trimming can involve hardware correction, by switching in or out of circuit current sources, resistors or capacitors. The temperature sensor can comprise a digital device, in which case the trimming can comprise a digital gain adjustment. Alternatively, a correction (delta) value can be stored in the memory of the device so that the temperature measurements taken are corrected when the measurements are taken.

During the calibration step, the speaker impedance is measured in the manner explained above, for example via the voltage and current measurement using a tone (evaluation) signal. This impedance is associated with the accurate amplifier temperature as measured by the trimmed on-chip temperature sensor.

It is assumed during this calibration that the speaker temperature and the amplifier IC will have the same temperature, and this will be the ambient temperature. In particular, no internal heating will have taken place as a result of the circuit operation, so that all components can be assumed to be at the ambient temperature.

The measured voltage and current values (or a derived impedance value) is stored in memory 195, together with the temperature value.

This memory can be the same on-chip flash memory as used for storing the input signal 120. The stored temperature and impedance information is then used as a reference. The real speaker coil temperature from this point can be calculated using this reference point and the changes in the impedance given by the voltage and current measurements.

The slope of the resistance versus temperature graph is known, because the temperature coefficient of the materials used in the speaker coil is known. The reference point provides one known point on the graph, so that the subsequent impedance measurement can be analysed in relation to the reference point.

Thus, during subsequent use of the loudspeaker, measurements are taken as outlined above to enable monitoring of the loudspeaker impedance, and the temperature is derived taking account of the reference information.

As mentioned above, the binding step takes place the first time a device is powered. It does not need to be repeated each time power is removed (for example for battery replacement). To detect that the binding process has taken place, an out-of-range default value can be stored in the flash memory (for example a temperature of −270° C.).

When the supply voltage is connected, the power-on-reset (POR) circuits inside the amplifier will secure the start up and initialization of the amplifier IC.

During this process, the flash memory can be checked for this out of range value. If the flash memory contains the default value, the binding process can be started. However if the memory already contains normal values, it means that the system is already binded.

For optional repairs, a re-bind command can be provided as part of the control interface of the system. However, a simpler implementation can perform the binding each time the power supply is connected.

The invention enables the device testing and assembly to be identical for all devices. The adaptation of temperature control system of the individual device, in order to make the control more accurate for the specific characteristics of the device, is carried out by the user. However, this does not require any active intervention by the user, and is simply performed as an automatic initial calibration which the user is not likely even to be aware of.

Figure 2:
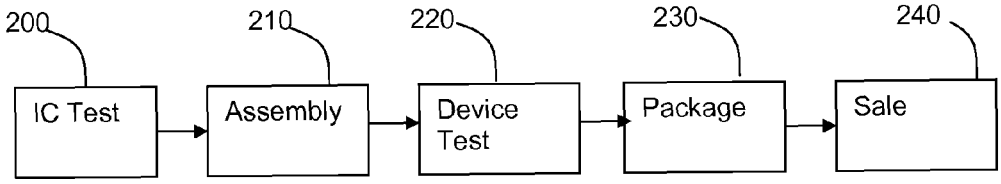
FIG. 2 shows a manufacturing process for a device using the loudspeaker system of the invention.

FIG. 2 shows the manufacture and assembly process.

Step 200 involves IC testing, and can include trimming of the temperature sensor integrated into the amplifier IC.

Step 210 involves assembly of the device including the PCB assembly and fitting the loudspeaker.

Step 220 is a final test of the end product, but with no device-specific calibration. The device is then packaged in step 230. In the case of a mobile phone, the battery is not fitted at this stage. The device is then shipped to the store.

The user purchases the device in step 240. The user connects the battery which automatically triggers the binding process.

The process described above uses an evaluation signal added to the audio signal, specifically to enable detection of the speaker electrical characteristics. The temperature of the voice coil is thus always based on a specific signal, rather than the signals that happen to be played at a given time. This makes the electrical analysis more robust.

The evaluation signal has a specific frequency. A spectral analyser can then be used for analysing the loudspeaker electrical characteristics. Many spectral transforms may be used, e.g., wavelet transforms etc. The Fourier transform is particularly effective for use in the spectral analyzer.

Using a Fourier Transform (such as the DFFT), the signal components for a set of frequencies can be performed, for example linearly spaced between 0 Hz and the Nyquist frequency, after which there would be restriction to a particular desired frequency, e.g., to the evaluation frequency.

The evaluation signal can be combined with the input sound signal during a limited time period, for example a period of 2 seconds. The electric response monitored during the limited time period is spectrally transformed. In a preferred embodiment, the spectral response according to the Fourier transform is derived only at the evaluation frequencies. The response may be averaged over the limited time period. The limited time period may be repeated or iterated, either immediately, or after a predetermined waiting interval, say of 5 seconds. Both averaging and a waiting interval avoid adapting the input sound signal too frequently, which may be noticeable to a listener of the system. Furthermore, averaging increases the accuracy of the temperature evaluation.

Preferably, the audible distortion introduced in the input sound signal is negligible for at least for practical purposes, compared to distortion introduced by other means, e.g., introduced due to a limited fidelity of the loudspeaker or introduced due to thermal distortion. The evaluation signal can for example be configured for the loudspeaker to generate no or inaudible sound in response to the evaluation signal. It is sufficient if there is an electric response of the voice coil to the evaluation signal which depends on its temperature. For example, the evaluation frequency can be below the resonant frequency of the loudspeaker. For example, a loudspeaker may be unable to efficiently produce sounds of a particular frequency, say of 100 Hertz or lower, although the voice coil of the loudspeaker does respond electrically to a signal component of that frequency in the loudspeaker signal. For such a loudspeaker the evaluation frequency may be chosen at the particular frequency, say at 100 Hertz.

The loudspeaker can be configured with a lower frequency bound below which the loudspeaker is configured for generating no or inaudible sound in response to signal components in the loudspeaker signal having a frequency below the lower frequency bound. The evaluation frequency can be below the lower frequency bound.

In this way, the evaluation signal will not cause an audible response; it will however produce an electric response. The electric response can be used for reliable and continuous temperature measurement while the user of the sound system cannot hear the presence of the evaluation signal.

The invention can be applied to all types of loudspeakers prone to heating problems. However, the use of an evaluation signal as described is more attractive for loudspeakers with high resonance frequencies, above 400 Hz, since these have a low efficiency in generating low frequencies. As a result, an evaluation signal that is used by the method will produce very low acoustical output.

The evaluation signal may also have a combination of low amplitude and low frequency which causes it not to produce an audible response in the loudspeaker.

As explained above, the system and method of the invention is for providing temperature protection.

A thermal protection scheme for the loudspeaker as may be implemented by signal adaption unit 180 can use one or more of the following (feedback) control signals, e.g. computed in controller 170 or signal adaption unit 180:

- the estimated voice coil temperature, or a smoothed version thereof,
- the magnitude of the impedance at the evaluation frequency, or a smoothed version thereof,
- the signal energy of the current at the evaluation frequency, or a smoothed version thereof. This is appropriate if the voltage component at the evaluation frequency can be assumed constant.

The feedback control system ensures that the voice coil temperature does not exceed a certain threshold value. This can be achieved by ensuring that the control signal(s) should or should not exceed a certain threshold. This can be obtained by controlling signal adaption unit 180 that adapts the input sound signal in a manner controlled by the control signal(s).

The processing can be, but is not limited to:

an attenuation of the input sound signal, a filtering operation of the input sound signal, an audio compression algorithm applied to the input sound signal.

It is possible to implement this processing module on the DSP or micro-controller that is used for estimating the voice coil temperature, or it can be implemented in analog hardware.

The invention is especially advantageous when applied to loudspeakers that are used close to their thermal limits. It is, in particular, attractive for mobile devices, in combination with methods for maximizing the sound-pressure-level (SPL) output of the loudspeaker. Indeed, driving a loudspeaker to its limits to maximize the SPL can cause severe heating of the loudspeaker, making a thermal protection scheme advantageous.

However, the invention can be applied more generally to any IC which drives any type of speaker. The required current sensing may already be provided by the amplifier IC which may use current sensing for diagnostic feedback.

The mobile devices for which the invention is of particular interest may include phones, laptops, netbooks, mp3 players, mobile navigation units. The invention is not limited to battery operated devices, and can be used in computers, televisions, barcode readers, electronic (and spoken) books, as well as car and home audio systems.

The invention can enable a reduction in damaged speakers.

The method of the invention can be implemented as a software algorithm, and as such the invention also provides a computer program comprising computer program code means adapted to perform the method, and the computer program can be embodied on a computer readable medium such as a memory.

Various modifications will be apparent to those skilled in the art.

The invention claimed is:

1. A method of controlling a loudspeaker of an electronic device to provide voice coil temperature protection, comprising:

when a power supply for the electronic device is activated, performing a binding step, which comprises taking measurements to enable determination of a loudspeaker impedance and measuring a temperature;

during subsequent use of the loudspeaker, taking measurements to enable monitoring of the loudspeaker impedance, and deriving the temperature using the measured temperature and corresponding loudspeaker impedance determined from the measurements taken in the binding step.

2. A method as claimed in claim 1, wherein measuring a temperature comprises using a temperature sensor forming part of an integrated circuit of the electronic device.

3. A method as claimed in claim 1, wherein taking measurements to enable determination of the loudspeaker impedance in the binding step comprises using a tone signal to drive the loudspeaker.

4. A method as claimed in claim 1, wherein the measurements comprise the voice coil voltage and current, and the determined and monitored loudspeaker impedance comprises the voice coil resistance.

5. A method as claimed in claim 1, further comprising storing in a memory the binding step measurements.

6. A method as claimed in claim 5, wherein storing the binding step measurements comprises overwriting default data, such that an absence of the default data is indicative that the binding step has taken place.

7. A method as claimed in claim 1, wherein the binding step is performed when the electronic device is first used by the consumer end-user.

8. A method as claimed in claim 1, wherein during subsequent use of the loudspeaker, taking measurements to enable monitoring of the loudspeaker impedance comprises generating an evaluation signal, and combining an input sound signal with the evaluation signal.

9. A method as claimed in claim 8, wherein the evaluation signal has a particular evaluation frequency.

10. A loudspeaker control system, comprising:

a loudspeaker;

a sensor for taking measurements to enable determination of a loudspeaker impedance;

a temperature sensor; and a processor, wherein the processor is adapted to:

implement a binding step during which sensor measurements are taken and a loudspeaker impedance is derived, and a temperature sensor measurement is taken; and implement monitoring during subsequent use of the loudspeaker, during which monitoring sensor measurements are taken and the temperature is determined using the binding step measured temperature and derived loudspeaker impedance.

11. A system as claimed in claim 10, wherein the temperature sensor forms part of an integrated circuit of an electronic device which incorporates the loudspeaker control system.

12. A system as claimed in claim 10 further comprising an evaluation signal generator and an element for combining an input sound signal with the evaluation signal.

13. A computer program embodied on a non-transitory computer readable medium comprising computer program code adapted to perform all the steps of claim 1 when said program is run on a computer.

* * * * *